United States Patent [19]

Mailer et al.

[11] 4,178,106

[45] Dec. 11, 1979

[54] PRINT GAP ADJUST MECHANISM FOR PRINTERS

[75] Inventors: Werner H. Mailer; Charles E. Milliser, both of Waynesboro, Va.

[73] Assignee: General Electric Company, Waynesboro, Va.

[21] Appl. No.: 855,007

[22] Filed: Nov. 25, 1977

[51] Int. Cl.[2] ..... B41J 3/04

[52] U.S. Cl. ..... 400/57; 400/653; 400/59

[58] Field of Search ..... 400/55-60, 400/653

[56] References Cited

U.S. PATENT DOCUMENTS

| | | | |
|---|---|---|---|
| 2,807,347 | 9/1957 | Metzner | 400/57 |
| 3,154,184 | 10/1964 | Gallant et al. | 400/57 |
| 3,960,256 | 6/1976 | Bickoff et al. | 400/59 |
| 4,019,619 | 4/1977 | Enenaker | 400/653 |
| 4,023,662 | 5/1977 | Perucca | 400/57 |
| 4,086,997 | 5/1978 | Wu | 400/57 |

*Primary Examiner*—William Pieprz
*Attorney, Agent, or Firm*—Michael Masnik

[57] ABSTRACT

The gap between the print head and the printing surface or platen in a printer is extremely critical in certain types of printers. Where printers are required to accept print media of various thickness (single or multipart paper), an adjust mechanism is required to optimize the print gap. A problem arises thereafter whenever ribbon has to be changed or new paper fed into the printer, since the print head must be retracted from its optimum gap position for ease of operation. The present invention provides for automatically resetting the print head to its predetermined previous gap spacing following movement of the print head away from the printing surface for servicing such as paper loading on ribbon replacement. This is accomplished by providing a lever, adapted to move the print head away from the printing surface, with a cam face for mating with a cam follower carried by a gap adjustment arm pivoted for movement in fixed distance increments about a pivot point. The movable arm serves as a memory for recording the previous print head gap spacing as well as providing extremely fine control for moving the print head in fine, fixed distance increments corresponding to the incremental distance movements of the movable arm.

6 Claims, 4 Drawing Figures

PRINT GAP ADJUST MECHANISM FOR PRINTERS

BACKGROUND OF THE INVENTION

This invention relates to printers and more particularly to an improved arrangement for automatically resetting the print head to its prior predetermined gap spacing with respect to said print surface following movement of the print head away from the print surface for servicing.

Serial printers such as matrix printers are well known in the prior art. A fairly common type of such printer involves a plurality of print wires or styli which are arranged in a vertical line. These styli are maintained in a spaced apart arrangement in a print head. The head is supported on a carriage which in turn is caused to traverse a line of movement across a record medium. As the carriage shifts the print head through successive columns along a line of movement on the record medium, a dot pattern of alphanumeric characters is produced on the record medium by selective displacement or extension of individual print styli in their successive column positions for impacting the record medium through the inked ribbon.

Whenever ribbon has to be changed or new paper fed into the machine, the print head must be retracted for ease of operation. Upon servicing the head must be returned to its printing position. It is important that the head be returned to a predetermined gap spacing with respect to the print surface of the record medium in order to insure uniformity of printing. Where the print head involves a stylus printer, it is known that the force of the impacting styli against the ribbon varies with the gap spacing. In a worst case condition, the wires never reach the ribbon to achieve printing. If the spacing is too close, smudging and tearing of the inked ribbon will occur. Between these two extremes the density or darkness of printing will vary. Accordingly, it is important that the print head be returned to its previous acceptable printing spacing with respect to the record medium in order to maintain uniformity of printing. Systems heretofore proposed have necessitated a manual adjustment of the gap setting between the print head and the record medium after every servicing of the print head. This oftentimes requires trial and error changes to achieve the desired print quality and results in undesirable delays in printing. In addition, other systems have employed arrangements where printing has to be suspended while the print head gap spacing is adjusted. These problems of spacing become more acute as the print speed increases, since the rebound time of the print styli and the gap spacing become increasingly critical in achieving uniformity of printing.

SUMMARY OF THE INVENTION

It is therefore an object of the present invention to provide an improved arrangement for automatically adjusting the print head gap spacing with respect to a recording record surface.

It is another object of the present invention to provide a print head gap adjusting arrangement which can be operated during printing.

Another object of this invention is to provide an improved arrangement for servicing a print head and for automatically resetting the print head to a predetermined gap spacing with respect to a print surface.

A further object of this invention is to provide an improved servicing option for a movable print head operating over critical gap spacings with respect to a printing surface.

In accordance with one aspect of the invention, there is provided an arrangement for automatically resetting the print head to a predetermined gap spacing with respect to a record medium following movement of the print head away from the record medium for servicing. The arrangement comprises a carriage mounted on a carriage rail positioned across the line of type to be printed on the record medium. The rail is mounted in eccentric end bearings carried by the side walls of the printer. A spring loaded lever attached to one of the eccentric bearings is provided for moving the print head about the center of the bearing which results in moving the print head away from the platen. A movable arm pivoted for movement about a pivot point at a first end thereof is provided for automatically resetting the print head. The arm comprises teeth at a second end thereof. A plurality of teeth are supported on a first assembly for mating with the teeth of the arm. A cam follower is provided on the arm at a location intermediate the first and second ends. The spring loaded lever comprises a cam face for mating with the cam follower. The cam face and its location respective to the center of the bearing is dimensioned such that moving the arm through successive teeth matings with the teeth of said assembly causes the print head to be moved corresponding constant increments of distance with respect to the platen.

BRIEF DESCRIPTION OF THE DRAWINGS

While the specification concludes with claims particularly pointing out and distinctly claiming the subject matter which is regarded as the invention, an illustration of several specific embodiments can be seen by reference to the specification in connection with the accompanying drawings, in which:

DETAILED DESCRIPTION OF A PREFERRED EMBODIMENT

Figure 1:
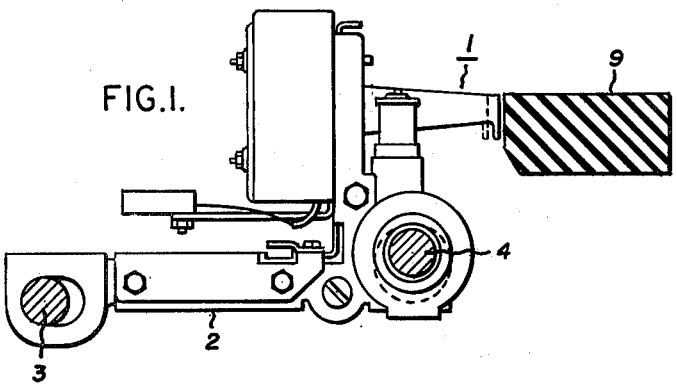
FIG. 1 is a side view of a print head mounted on carriage rails in a printer.

Referring to FIG. 1 there is shown a print head 1 mounted on a carriage 2 which rides on two rails 3 and 4. Print head 1 is shown for exemplary purposes as comprising a stylus matrix print head whose individual styli are electrically energized for movement in the direction of the platen or printing surface 9. The carriage 2 is driven across a line of type on the record medium and during this movement the individual print wires are actuated to impact the record medium such as paper through an inked ribbon not shown. The mechanism for driving the carriage and operating the individual print wires or ink jet nozzles are well known in the art and need not be discussed in further detail. While the explanation will proceed on the basis of such a print head, it is obvious that the print head can constitute any other type of printing arrangement. For example, the print head 1 could comprise an ink jet printer wherein droplets of ink are ejected from the nozzle of the print head 1 for impacting the record medium to produce print thereon.

Figure 3:
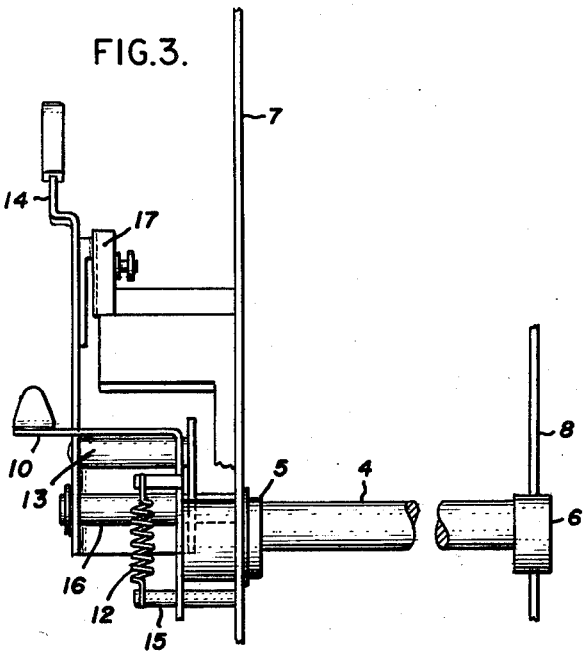
FIG. 3 is a front view of the adjusting mechanism and illustrates its relationship to the carriage rails and eccentric bearings.
Figure 4:
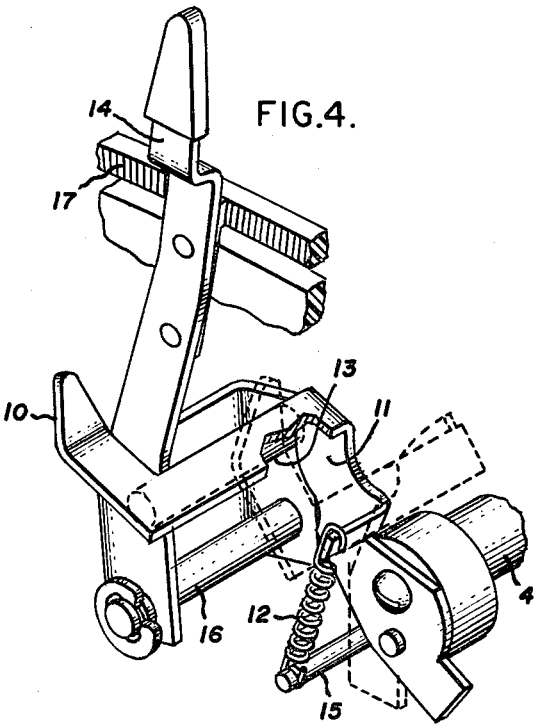
FIG. 4 is a perspective view of the adjusting mechanism showing in greater detail the manner in which the cam follower and the cam portion cooperate.

To the ends of the rails 4 are firmly attached two eccentric bushings 5 and 6 shown in greater detail in FIG. 3. Rail 4 is shown as spanning a line of type on a record medium. Assembly of rail 4 and bushings 5 and 6 are free to rotate in a hole in the side frames 7 and 8 of the printer. While the carriage 2 is able to slide lengthwise on rail 3 it has to follow the eccentric motion of rail 4 in movement transverse thereto. The geometry of rails 3 and 4, bushings 5 and 6, carriage 2 and print head 1, results in the eccentric motion of the rail 4, and allows for varying the gap between the striker bar or platen or printing surface 9 and the print head 1.

Figure 2:
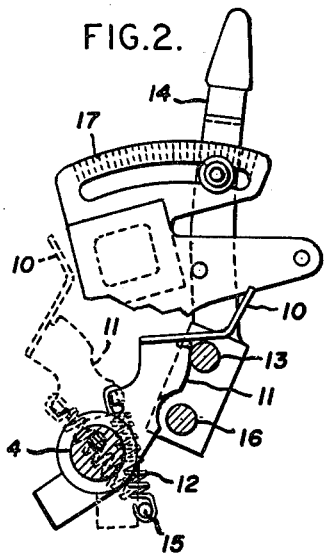
FIG. 2 is a side view of the adjusting mechanism showing the details of the cam and cam follower.

To move the print head away from the printing surface 9, the lever 10 is provided. This lever is firmly attached to 5, one of the eccentric bearings, and includes a cam portion 11. The position of the cam portion as shown in the solid line in FIG. 2 represents a position with the print head located a predetermined fixed distance with respect to the recording surface. The adjustment of this distance is relatively critical as previously indicated in order to insure uniformity printing quality. The cam position represented in dotted line represents the print head rotated about the eccentric axis of rail 4 away from the printing surface along an arc which approximates a straight line movement away from the printing surface. In order to automatically reset the print head after movement of said print head away from said printing surface by lever 10, there is provided a movable arm 14 pivoted for movement about a pivot point 16 at a first end thereof and comprising teeth 17 at a second end thereof. A plurality of teeth are supported on a first assembly 17 for mating with the teeth of the movable arm. Arm 14 carries a cam follower 13 provided in one embodiment at a location intermediate the previously mentioned ends of the arm. The spring loaded lever 10 comprises a cam face 11 for mating with the cam follower. The cam face and its location with respect to the center of the bearing 5 is dimensioned such that moving the arm through successive teeth matings with the teeth of the assembly 17 causes the print head to be moved a constant increment of distance with respect to the platen. The rotational movement of lever 10 is controlled by over center spring 12 and the cam follower 13 on the fine adjust arm 14. The largest possible gap between the striker bar 9 and print head 1 exists with the lever 10 in the paper load position. In this position the lever 10 is pulled by the spring 12 in its over-the-center position against a stud 15 mounted on the side frame of the printer. Arm 14 pivoting on pivot point or stud 16 can swing through an arc of approximately 20 degrees. With the ratchet assembly 17 this motion is controllable to increments of forty-five minutes of a degree per step, and portion 11 of lever 10 resting on cam follower 13 translates the 45 minute steps through eccentrics 5 and 6 into constant increments of gap spacing of the head in the order of 0.001 inches.

Thus it is seen that without disturbing the desired location of lever 14 which is held in its place by ratchet assembly 17, the lever 10 can be moved freely by the operator between its two limits, stud 15 which represents the paper load position and cam follower arm 13 which represents the print position.

The spring 12 thus normally causes the cam to follow movement of the cam follower. However, the over-center arrangement of the spring also provides an arrangement for maintaining the print head in a spaced apart position with respect to the platen in its open position as shown in dotted line in FIG. 2.

The present invention enables an operator to move the arm 14 even during printing in order to adjust the spacing between the tip of the print head and the printing surface 9 to optimize the print gap dimension for desired printing. Also, in the event the print head is moved away from the printing surface by lever 10 in order to service the print head, as for example to replace ribbon or insert new paper forms, operation of the lever to its printing position together with the arm mechanism results in the print head being returned to its previous gap spacing with respect to the printing surface.

A particular embodiment of the invention has been shown and described. Those skilled in the art will recognize modifications and design changes in order to accommodate this invention to equipment other than that specifically described herein. All such modifications as may come within the skill of those in the art are intended to be embraced within the scope of the appended claims.

What I claim as new and desire to secure by Letters Patent of the United States is:

1. In a printer wherein it is desired to move the print head away from a predetermined gap spacing with respect to a print surface for servicing and for resetting the print head to said predetermined gap spacing comprising, means for moving said print head away from said surface comprising a lever for rotating said print head eccentrically about an axis, said means for resetting said print head comprising a movable arm pivoted for movement in fixed distance increments about a pivot point, a cam follower provided on one of said arm and lever, said other of said arm and lever comprising a cam face for mating with said cam follower, the cam face and its location with respect to the center of said axis being dimensioned such that moving the movable arm through successive increments of distance causes the print head to be moved correspondingly fixed distance increments of distance with respect to said surface.

2. In a printer wherein it is desired to move the print head away from a predetermined gap spacing with respect to a print surface for servicing and for resetting the print head to said predetermined gap spacing comprising, means for moving said print head away from said surface comprising a lever for moving said print head eccentrically about an axis, said means for resetting said print head comprising a movable arm pivoted for movement in fixed distance increments about a pivot point, a cam follower provided on one of said arm and lever, said other of said arm and lever comprising a cam face for mating with said cam follower, the cam face and its location with respect to the center of said axis being dimensioned such that moving the movable arm through successive increments of distance causes the print head to be moved correspondingly fixed distance increments of distance with respect to said surface, and said lever comprises a spring for normally causing said cam to follow movement of said cam follower.

3. An arrangement according to claim 2 comprising means for maintaining said print head in a spaced apart position with respect to said platen.

4. An arrangement according to claim 3 wherein said last named means comprises said spring being mounted in an over-center position with respect to the axis of the cam.

5. In a printer wherein it is desired to move the print head away from a predetermined gap spacing with respect to a platen for paper loading or ribbon replacement, an arrangement for resetting the print head to said predetermined gap spacing comprising, a carriage mounted on a rail for moving said print head across a line of type on a record medium, means for moving said print head away from said platen comprising a spring loaded lever for moving said carriage and rail eccentrically about an axis, said means for resetting said print head comprising a movable arm pivoted for movement about a pivot point at a first end thereof and comprising teeth at a second end thereof, a plurality of teeth supported on a first assembly for mating with said arm teeth, a cam follower provided on said arm at a location intermediate said first and second ends, said spring loaded lever comprising a cam face for mating with said cam follower, the cam face and its location with respect to said axis being dimensioned such that moving the arm through successive teeth matings with the teeth of said assembly causes the print head to be moved corresponding constant increments of distance with respect to the platen.

6. In a printer wherein it is desired to move the print head away from a predetermined gap spacing with respect to a platen for paper loading or ribbon replacement, an arrangement for resetting the print head to said predetermined gap spacing comprising, a carriage for moving said print head across a line of type on a record medium, said carriage being mounted on a carriage rail positioned across said line of type, said rail being mounted in eccentric end bearings carried by side walls of said printer, means for moving said print head away from said platen comprising a spring loaded lever attached to one of said eccentric bearings for moving said print head about the center of said bearing, said means for resetting said print head comprising a movable arm pivoted for movement about a pivot point at a first end thereof and comprising teeth at a second end thereof, a plurality of teeth supported on a first assembly for mating with said arm teeth, a cam follower provided on said arm at a location intermediate said first and second ends, said spring loaded lever comprising a cam face for mating with said cam follower, the cam face and its location with respect to the center of said bearing being dimensioned such that moving the arm through successive teeth matings with the teeth of said assembly causes the print head to be moved corresponding constant increments of distance with respect to the platen.

* * * * *